US005881474A

United States Patent [19]

Berger

[11] Patent Number: 5,881,474

[45] Date of Patent: Mar. 16, 1999

[54] CLOTHES DRYER FLEXIBLE HOSE SUPPORT

[76] Inventor: Edwin L. Berger, 115 Albany Ave., Amityville, N.Y. 11701

[21] Appl. No.: 791,910

[22] Filed: Jan. 31, 1997

[51] Int. Cl.[6] ..... F26B 19/00

[52] U.S. Cl. ..... 34/235; 248/48.1; 248/58; 248/75

[58] Field of Search ..... 34/235; 248/48.1, 248/48.2, 58, 59, 60, 75, 79

[56] References Cited

U.S. PATENT DOCUMENTS 3,747,166 7/1973 Eross ..... 248/75
3,897,923 8/1975 Paepke et al. ..... 248/75
5,121,948 6/1992 Anderson et al. ..... 34/235

*Primary Examiner*—Henry Bennett
*Assistant Examiner*—Pamela A. Wilson
*Attorney, Agent, or Firm*—Myron Amer P.C.

[57] ABSTRACT

For a contracting and expanding bellows hose connected from a clothes dryer to an opening in a wall to vent hot air to atmosphere, a kink-obviating hose support on the back of the dryer which limits contraction and expansion to a selected length portion of the hose, wherein there is adequate hose expansion to permit movement away from the wall to provide working clearance for maintenance and yet, when the dryer is moved back against the wall, the length portion is too short to fold or kink as would block the exiting flow of the hot air.

1 Claim, 1 Drawing Sheet

CLOTHES DRYER FLEXIBLE HOSE SUPPORT

The present invention relates generally to improvements for a clothes dryer, the improvements more particularly obviating overheating in the operation of the clothes dryer.

EXAMPLES OF THE PRIOR ART

Typically, the in-use position of a clothes dryer is adjacent a wall having a venting opening to atmosphere and consequently a shortened reach of its venting hose connected in spanning relation between an outlet in the back of the clothes dryer and the wall venting opening.

Included in the clothes dryer set-up is a support for the venting hose, such as exemplified by U.S. Pat. No. 5,257,468 issued to Lebrun on Nov. 2, 1993 and U.S. Pat. No. 5,121,948 issued to Anderson et al. on Jun. 16, 1992, to mention but a few.

In the aforesaid and all other known prior patents, the venting hose support provides the utility, but of a limited extent, of preventing kinking in the venting hose in its condition extending between the wall and clothes dryer openings, since any kink would restrict the exhausting of hot air and cause overheating in the clothes dryer. To service the clothes dryer, however, clearance or access to the back of the clothes dryer is often required, and this requires movement of the clothes dryer and, after the maintenance or whatever, the movement of the clothes dryer back to its original position, and thus positional changes in the clothes dryer which the known prior art supports lack the utility to prevent from causing kinking in the venting hose as might result from these positional changes.

Broadly, it is an object of the present invention to overcome the foregoing and other shortcomings of the prior art.

More particularly, it is an object to support the venting hose so as to confine the expansion and contraction of its known construction to a length portion that is adequate for the positional movements, but not of a length that will result in kinking during movement of the clothes dryer from its maintenance non-use position into its in-use position, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
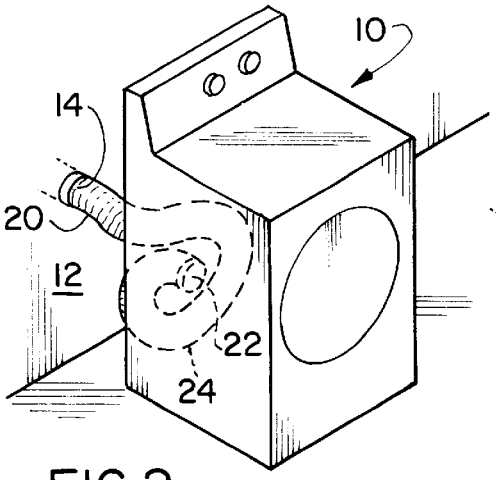
FIG.2 PRIOR ART
FIG. 2 is similarly a perspective view of the clothes dryer of FIG. 1 but in its typical in-use position and illustrating said venting hose in a kinking configuration.
Figure 1:
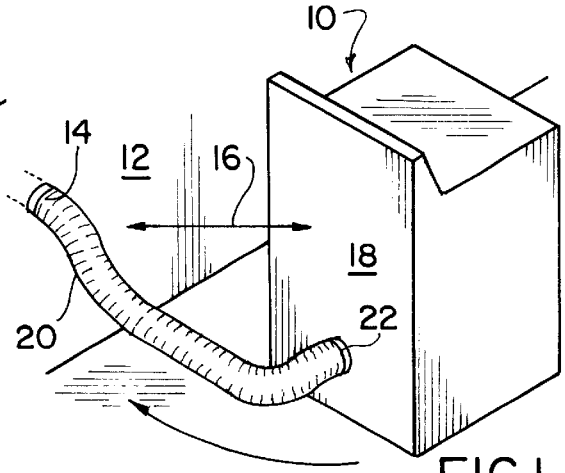
FIG.1 PRIOR ART
FIG. 1 is a perspective view of a clothes dryer in a typical position for maintenance service illustrating a prior art venting hose connection from the clothes dryer to atmosphere.

Shown in FIGS. 1 and 2 is a clothes dryer 10 of a type having an in-use position, as shown in FIG. 2, in which it is adjacent a wall 12 having a venting opening 14 to atmosphere and a non-use position, as shown in FIG. 1, in which clearance 16 is provided between the wall 12 and the back 18 of the clothes dryer 10 for maintenance. Clothes dryer 10 has a known expanding and contracting venting hose 20 connected in spanning relation between a clothes dryer outlet opening 22 and the wall outlet opening 14 for exhausting hot air used in the clothes-drying service of the dryer 10. A typical unavoidable occurrence, illustrated in FIG. 2, is the assumption of a configuration, as at 24, in the venting hose 20 when the clothes dryer 10 is moved from its non-use or maintenance position of FIG. 1 back to its in-use position of FIG. 2, and this configuration 24 manifests what can aptly be termed a "kink" in the flow passage of the venting hose 20 which restricts exiting flow of the hot air and causes overheating problems adversely affecting the operation of the clothes dryer 10.

Figure 5:
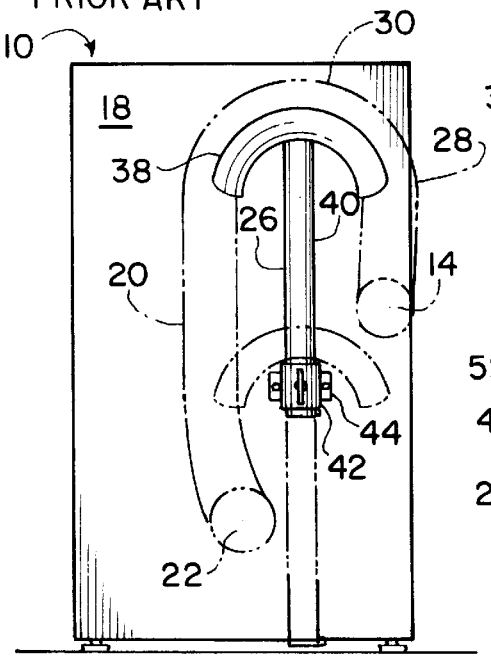
FIG. 5 is a rear elevational view of the clothes dryer illustrating the venting hose in phantom perspective in at two exemplary positions.
Figure 6:
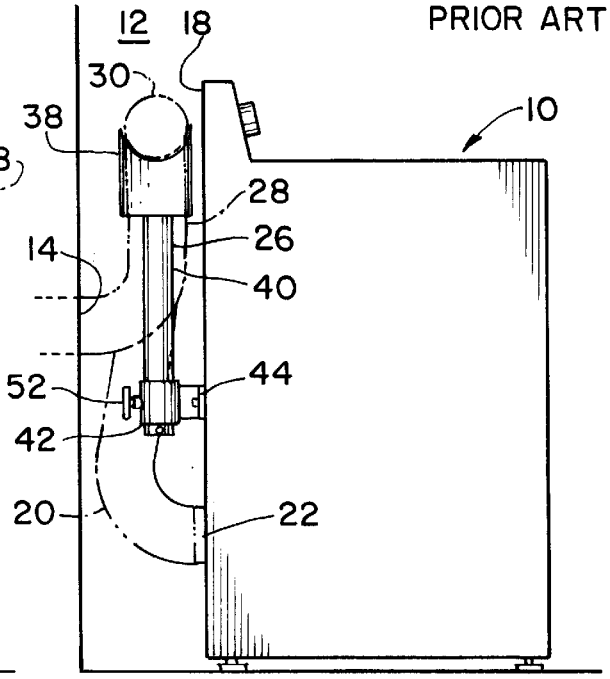
FIG. 6 is a right side elevational view projected from FIG. 5.
Figure 3:
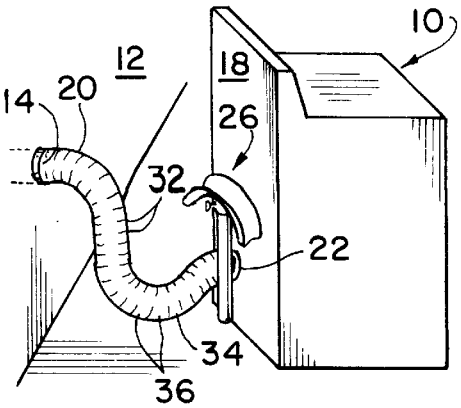
FIG. 3 is a perspective view similar to FIG. 1, and illustrating use of a hose-supporting bracket in accordance with the present invention.
Figure 4:
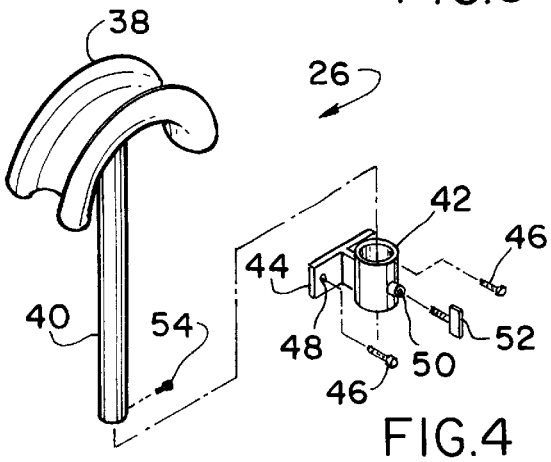
FIG. 4 is an isolated perspective view of the hose-supporting bracket of FIG. 3 in disassembled relation.

As best shown in FIG. 3, the obviating of a kink in the venting hose 20 is achieved using a vertically adjustable hose-supporting bracket, generally designated 26, appropriately mounted on the back 18 of the clothes dryer 10. As will be subsequently more fully explained, underlying the present invention is the recognition that the expanding and contracting construction of the venting hose 20 is advantageously used by confining the expanding and contraction thereof, which is adequate for movement between the in-use and non-use clothes dryer positions of FIGS. 1 and 2, only to the length portion 28 (see FIGS. 5, 6) extending from the bracket 26 to the wall outlet 14, and using the flexibility only of the hose construction for the draping thereof, as at 30, over the bracket 26 and to reach from the dryer outlet 22 to the bracket 26.

Stated somewhat differently, it has been found in practice that with only the hose length portion 28 expanding and contracting during positional movements of the clothes dryer 10, there is lacking the dimensional length in the length portion 28 to assume a kink-producing configuration 24. Yet, the known expanding and contracting construction of the venting hose 20, consisting of helical turns of wire, denoted individually and collectively at 32, and foil tubing, generally designated 34, sandwiching the wire therebetween and producing expanding and contracting pleat means, individually and collectively designated 36, provides adequate dimensional changes to accommodate the positional movements of the clothes dryer 10.

For completeness' sake, it is noted that a preferred embodiment of the hose-supporting bracket 26 includes a semi-circular inverted U-shape or saddle 38 having a depending shaft 40 that is slidably disposed in a collar 42 attached to a mounting flange 44 using mounting screws 46 disposed through flange openings 48 into the back 18 of the clothes dryer 10. A threaded-through bore 50 of the collar 42 receives a cooperating threaded set screw 52 to hold the saddle 38 in a selected elevated position. To prevent inadvertent complete removal of the shaft 40 during vertical adjustment of the saddle 38, use is made of a screw stop 54 at the bottom of the shaft 40.

While the apparatus for practicing the within inventive method, as well as said method herein shown and disclosed in detail, is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a clothes dryer of a type having an in-use operative position adjacent a wall having a venting outlet and an operative non-use position in a clearance position from said wall incident to providing a working area between said wall and said clothes dryer to allow maintenance service to said clothes dryer, said clothes dryer having a hot air discharge opening in close relation to a wall venting opening in said clothes dryer in-use operative position and in spaced-apart relation to said wall venting opening in said non-use operative position, said improvements contributing to obviating any kinking in a hose connected in spanning relation between said wall venting and clothes dryer discharge openings comprising a helical construction in said hose effective to allow lengthwise expansion and contraction in said hose incident to corresponding expansion and contraction in the spacing between adjacent helical turns of said construction, an inverted U-shaped hose-supporting bracket mounted on said clothes dryer in facing relation to said wall, and an operative position of said hose in supported relation upon said hose-supporting bracket at a location interposed between said clothes dryer hot air discharge opening and said wall venting opening.

* * * * *